US008726516B2

(12) United States Patent
Han et al.

(10) Patent No.: US 8,726,516 B2
(45) Date of Patent: May 20, 2014

(54) METHOD FOR MANUFACTURING INCLINED CURVE-TYPE BLADE BODY, BLADE BODY MADE THEREFROM, AND NAIL CLIPPER HAVING BLADE BODY THEREOF

(75) Inventors: Jeong Sik Han, Seoul (KR); Gyoung Hee Kim, Seoul (KR)

(73) Assignees: Jeong Sik Han, Seoul (KR); Gyoung Hee Kim, Seoul (KR)

( * ) Notice: Subject to any disclaimer, the term of this patent is extended or adjusted under 35 U.S.C. 154(b) by 113 days.

(21) Appl. No.: 13/422,449
(22) Filed: Mar. 16, 2012
(65) Prior Publication Data

US 2012/0210583 A1 Aug. 23, 2012

Related U.S. Application Data

(63) Continuation of application No. PCT/KR2010/006528, filed on Sep. 27, 2010.

(30) Foreign Application Priority Data

Oct. 9, 2009 (KR) ..... 10-2009-0096208

(51) Int. Cl.
*A45D 29/02* (2006.01)
*B24B 1/00* (2006.01)
*B24B 3/40* (2006.01)

(52) U.S. Cl.
USPC ..... 30/28; 76/106.5; 451/45

(58) Field of Classification Search
USPC ..... 30/28; D28/60; 451/45
See application file for complete search history.

(56) References Cited

U.S. PATENT DOCUMENTS 782,654 A * 2/1905 Hart ..... 30/28
1,430,779 A * 10/1922 Winter ..... 132/75.5
D446,886 S * 8/2001 Park ..... D28/62
6,438,845 B1 * 8/2002 Jung ..... 30/29
D466,251 S * 11/2002 Park ..... D28/62
6,705,014 B2 * 3/2004 Park ..... 30/28
7,234,238 B2 * 6/2007 Wong ..... 30/28
D594,156 S * 6/2009 Kita ..... D28/60
8,001,692 B2 * 8/2011 Han et al. ..... 30/28
2004/0148779 A1 * 8/2004 Choi et al. ..... 30/28
2009/0000122 A1 * 1/2009 Han et al. ..... 30/28
2009/0211098 A1 * 8/2009 Childs, II ..... 30/28
2012/0210583 A1 * 8/2012 Han et al. ..... 30/28

FOREIGN PATENT DOCUMENTS

DE 199 62 226 A1 * 12/2000
JP 5-329022 * 12/1993
JP 2004-283556 * 10/2004
JP 2005-7119 * 1/2005
JP 2005-74135 * 3/2005
JP 2006-000604 1/2006
KR 10-0497063 6/2005
KR 10-0674475 1/2007
WO WO 2007/081157 A1 * 7/2007

* cited by examiner

*Primary Examiner* — Hwei C Payer
(74) *Attorney, Agent, or Firm* — IP & T Group LLP

(57) ABSTRACT

The present invention is related to a method for manufacturing a blade body of a nail clipper having a 3-dimensional inclined curve-type blade, including steps of forming an inclined curve with a curvature Ra using a boundary line which is formed when the periphery of grinding media with a radius Rg in an upright position is merged with an upper inclined surface having a predetermined angle $\theta_1$ with respect to a vertical line, forming a lower inclined surface by extending the inclined curve downward at an angle $\theta_2$ corresponding to the angle $\theta_1$, forming blade bodies using the upper and lower inclined surfaces to be inner inclined surfaces of the blade bodies, and grinding the ends of the upper and lower inclined surfaces simultaneously via grinding media with the radius Rg, whereby forming upper and lower 3-dimensional inclined curve-type blades with the curvature Ra, respectively.

9 Claims, 12 Drawing Sheets

METHOD FOR MANUFACTURING INCLINED CURVE-TYPE BLADE BODY, BLADE BODY MADE THEREFROM, AND NAIL CLIPPER HAVING BLADE BODY THEREOF

CROSS-REFERENCE TO RELATED APPLICATIONS

This application is a continuation of PCT international application number PCT/KR2010/006528 filed on Sep. 27, 2010, which claims priority of Korean patent application number 10-2009-0096208 filed on Oct. 9, 2009. The disclosure of each of the foregoing applications is incorporated herein by reference in its entirety.

TECHNICAL FIELD

The present invention relates to a nail clipper, and more particularly, to a method for manufacturing an inclined curve-type blade body, a blade body made therefrom, and a nail clipper having the blade body thereof which has a 3-dimensional structure complying with the curvature of a user's nail and is also capable of mass production of the same having the inclined curve-type blades exactly engaged with each other regardless of a grinding deviation.

BACKGROUND ART

In general, a conventional nail clipper is provided with upper and lower blades constituting a blade body, which are in the form of inclined surfaces with symmetric structures. The upper and lower inclined surfaces are formed in slightly concave surfaces having the same curvatures. The upper and lower blades having the constructions as such can be manufactured by simultaneously grinding the ends of the blade bodies using grinding media which have a radius corresponding to the curvature of the ends of the blade bodies being horizontally engaged with each other.

FIGS. 1 to 5 are schematic views each illustrating the classification of the engagement pattern of the upper and lower blades for various nail clippers. FIG. 1 shows constructions of a conventional nail clipper, wherein the blades of the upper and lower blade bodies are engaged with each other with a curve (A-B-C) in the X-Y plane. In the drawings, points A and C indicate the opposite ends of a blade, respectively and the point B is the center of the blade. FIG. 2 shows constructions of another conventional nail clipper, wherein the blades of the upper and lower blade bodies are engaged with each other with a straight line (A-B-C) in the X axis.

Referring to FIG. 1, the upper and lower blades in the prior art are formed in concave curved surfaces when seen from the plan view as shown in FIG. 1(*d*), so a user's nail can be cut in a circular pattern. However, when seen from the front view as shown in FIG. 1(*b*), the upper and lower blades are engaged together in a straight line. Therefore, since the user has to cut his/her nail with a circular curved-surface shape using the upper and lower blades to be engaged with in a straight line, some problems are raised therefrom.

In other words, when the user uses a conventional nail clipper having horizontal upper and lower blades as shown in FIG. 1, the end portion of the nail should be inserted between the upper and lower blades to be pressed together. Then, a downward force is applied to the middle convex portion of the nail, while a lifting force is exerted on the opposite edge portions of the nail. At this moment, the forces exerted in the opposite directions, i.e., shearing forces are applied to the nail itself, and the cutting operation of the nail is then performed while the nail is flatly retained between the upper and lower blades. Consequently, whenever the nail clipping operation is performed, stress and strain are repetitiously applied to the nail. Even in a severe case, the conventional nail clipper as described above has drawbacks in that a frail or weak nail may be damaged, or eventually torn or broken.

In order to resolve or lessen the drawbacks in the conventional nail clippers, a variety of technologies have been proposed. For instance, there is a Korean Patent No. 10-0674475 (Jan. 19, 2007) entitled "a method for manufacturing an arc-type blade body, the blade body made therefrom, and a nail clipper having the blade body" which was issued to the same applicant of the present invention. This patent relates to a manufacturing method for a two (2)-dimensional vertical and curve-type blade which is referenced to the present invention, wherein the upper and lower blade bodies are engaged with each other with a vertical curve (A-B-C) in the X-Z plane. The upper and lower blades of the blade body engaged with each other are in the form of an upward curve-shape, when seen from the front view. Since these blades are designed to comply with the cross-sectional shape of the nail having a curved surface, thereby considerably reducing the stress and the strain applied to the nail during the clipping operation. The blade body with the constructions as the above may be a useful technology for the users who want to cut their nails in a straight line following the art of nail fashion like a nail art. However, since the end of the nail is cut in the straight line, it cannot be employed to the case where the user wants to cut the nail in a curve-shape.

In order to solve the problems as described above, as shown in FIGS. 4 and 5, a curve-type blade with a three (3)-dimensional structure may be proposed, wherein the upper and lower blades are engaged with each other in the shape of an upward curve-shape, and at the same time slightly inclined rearward in a direction of the handle, i.e., in a longitudinal direction of the blade body. However, such a proposal is just an idea, which has been regarded as technically impossible up to now to manufacture the curve-type blade having such a geometrical structure.

Meanwhile, a variety of technologies relating to the blade body of the nail clipper have been proposed as following: For example, Korean Patent Laid Open No. 10-2004-0043581 (May 24, 2004), Japanese Utility Model Laid Open Sho49-120419 (Oct. 16, 1974), Japanese Utility Model Laid Open Sho51-119970 (Sep. 12, 1977), Japanese Utility Model Laid Open Sho54-98369 (Jul. 11, 1979), Japanese Utility Model Laid Open Sho54-116468 (Aug. 15, 1979), Japanese Utility Model Laid Open No. 2005-74135 (Mar. 24, 2005), Japanese Utility Model Laid Open Pyoung01-145305 (Oct. 5, 1989), and U.S. Design Pat. No. 371, 636 (Jul. 9, 1996), or the like.

In particular, U.S. Design Pat. No. 371, 636 discloses that the end portions of the upper and lower blades of the nail clipper have inclined curve-type surfaces. However, this patent just discloses such a design for an exterior shape of the nail clipper, but is silent on the technical method how to manufacture such inclined curve-type blades.

Some prior arts in the above list roughly mention about the shape of the nail clipper having an inclined curve-type blade or its usefulness. However, they only raise problems to be solved or suggest idea on the shape of the inclined curve-type blade, but they fail to propose the manufacturing technologies or theoretical backgrounds how to construct and produce the inclined curve-type blade as such.

Generally, the blade grinding work in the manufacturing process of the nail clipper is performed in a short period of time about 1-2 seconds by bringing the blades into contact with the grinding media. At this point, the upper and lower blades should be manufactured to be exactly engaged with each other. However, during a manual or an automatic grinding work, a deviation in the respective grinding depths of the blade is inevitably generated due to the jig of a grinding machine, grinding work conditions, degrees of the worker's skillfulness or the like.

In other words, the grinding work of the blades of the nail clipper may be divided into a manual, a semi-automatic or fully automatic work. Generally, a grinding roller with a radius suitable for the curvature of the curved surface of the end portion of the blade is used in the grinding work. The manual grinding work has a considerable difference in its grinding result depending upon the skillfulness of the worker. Further, in the semi-automatic or fully automatic grinding work there also generates deviations due to the jig or the transporting mechanism or a variety of deviations according to the degree of wear of the grinding media. Because of these deviations, the middle portion of the upper and lower blades is likely to be opened or the gap between the opposite edges of the upper and lower blades are widened after the grinding work, which makes it difficult to obtain a nail clipper having a desired quality.

Meanwhile, a nail clipper of which upper and lower blades are exactly engaged with each other may be manufactured by elaborate manual grinding works. However, in order to mass-produce the nail clipper having a uniform, precise and high quality, a theoretical background and manufacturing technology for production of the nail clipper must be provided to support that. In other words, it is necessary to propose a method for forming an inclined curve-type blade body whose upper and lower blades are exactly engaged with each other regardless of the grinding work condition, so as to mass-produce the blade body with the same quality of which upper and lower blades are precisely engaged with each other without any gap therebetween. At this point, it is very important to provide conditions for the mass production of the blade body having the same quality despite the existence of the considerable deviations in the grinding depth.

However, in the technical fields relating to the nail clipper, there has been yet no technical solution or proposal about how to manufacture the inclined curve-type blade body, whose upper and lower blades are exactly engaged with each other in the 3-dimensional space. Moreover, they are silent on which conditions are required to mass produce the nail clipper having the inclined curve-type blade body with the same quality regardless of the existence of the considerable grinding deviations. This appears to be certain that the technology or method to produce the inclined curve-type blade having such a 3-dimensional structure has not been found up to now. Such assumption as the above can be supported by the fact that there have been no nail clippers having such an inclined curve-type blade among the commercially developed and marketed nail clippers to this date.

DISCLOSURE

Technical Problem

Accordingly, the present invention has been made to solve the above-mentioned problems encountered in the prior art, and the primary object of the present invention is to provide a method for manufacturing an inclined curve-type blade body of a nail clipper which allows to practically mass-produce inclined curve-type blades which have been suggested only as a design in the prior art.

It is another object of the present invention is to provide a method for manufacturing an inclined curve-type blade body of a nail clipper which has a 3-dimensional structure complying with the curvature of a user's nail and allows the user to cut the nail in a curved shape along its curvature without any damage thereto.

Further, it is still another object of the present invention is to provide a method for manufacturing an inclined curve-type blade body of a nail clipper whose upper and lower blades are exactly engaged with each other regardless of grinding deviations in the grinding process, and which can be mass-produced with the same quality.

Technical Solution

In accordance with one aspect of the present invention, there is provided a method for manufacturing a blade body of a nail clipper wherein a 3-dimensional inclined curve-type blade is formed on respective inclined surfaces of upper and lower blade bodies facing each other, including steps of: forming an inclined curve with a curvature Ra using a boundary line which is formed when the periphery of a grinding media with a radius Rg located in an upright position is merged with an upper inclined surface having a predetermined angle $\theta_1$ with respect to a vertical line; forming a shape of a lower inclined surface by consecutively extending the inclined curve downward at an angle $\theta_2$ corresponding to the inclination angle $\theta_1$ of the upper inclined surface to make a trajectory for forming a surface which constitutes the lower inclined surface; forming blade bodies by constructing the shape of the upper and lower inclined surfaces obtained in the steps above to be inclined surfaces inside the blade bodies of the nail clipper; and grinding the ends of the upper and lower inclined surfaces simultaneously by the grinding media with the radius Rg while maintaining the axis (Z axis) of the grinding media perpendicular to the axis (Y axis) of the blade bodies, whereby forming upper and lower inclined curve-type blades having the inclined curve with the curvature Ra, respectively.

The forming step of the inclined curve with the curvature Ra includes determining the curvature Rn of the blade bodies seen from the front view of the nail clipper upper in response to the curvature of a nail, determining the curvature Rb of the upper inclined surface on the basis of the conditions on the inclination angle $\theta_1$, the width W of the blade and the radius Rg of the grinding media to make the shape of the upper inclined surface, and forming the inclined curve with the curvature Ra along the upper inclined surface.

The forming step of the inclined curve with the curvature Ra includes determining the curvature Rb of the upper inclined surface to make the shape of the upper inclined surface, and forming the inclined curve with the curvature Ra on the basis of the conditions on the inclination angle $\theta_1$, the width W of the blade and the radius Rg of the grinding media.

The upper and lower blade bodies are integrally formed with each other at the opposite ends of a metal sheet, and the metal sheet is bent at an imaginary center line in its longitudinal direction while the upper and lower inclined curve-type blades facing each other.

The other end portions of the upper and lower blade bodies are secured to each other using a joining means, wherein the joining means is one selected from the group of a spot welding, a riveting, an eyeleting, a brazing, or a bending work.

In accordance with another aspect of the present invention, there is provided an inclined curve-type blade body of a nail clipper, including: an upper blade body formed with a downward inclined surface at one end; and a lower blade body formed with an upward inclined surface corresponding to the inclined surface of the upper blade body at one end for cutting a user's nail in cooperation with the upper blade body; wherein the upper and lower blade bodies are provided with upper and lower inclined curve-type blades which are respectively manufactured from a method defined in the present invention.

In accordance with still another aspect of the present invention, there is provided a nail clipper, including: an upper blade body formed with a downward inclined surface at one end; a lower blade body formed with an upward inclined surface corresponding to the inclined surface of the upper blade body for cutting a user's nail in cooperation with the upper blade body; and a lever for applying a force to the upper and lower blades to cut the user's nail; wherein the upper and lower blade bodies are provided with upper and lower inclined curve-type blades which are respectively manufactured from a method defined in the present invention.

In the alternative, the upper and lower blades are formed with a nail collecting part at its respective end portions for preventing the nail being cut from scattering towards the surroundings.

Alternatively, the upper and lower blade bodies are provided with supporting shaft holes, respectively, and wherein a nail clipper body for applying a force to the upper blade body is coupled between the upper blade body and the lever through a supporting shaft inserted in the supporting shaft holes.

In accordance with still another aspect of the present invention, there is provided a nail clipper, including: an upper blade body formed with a downward inclined surface at one end; and a lower blade body formed with an upward inclined surface corresponding to the inclined surface of the upper blade body and pivotably coupled with the upper blade body thorough a pivot; wherein the inclined surface of the upper blade body is formed with a concave inclined curve-type blade with a predetermined curvature or a flat inclined curve-type blade; wherein the inclined surface of the lower blade body is formed with a convex inclined curve-type blade or a flat inclined curve-type blade corresponding to the concave inclined curve-type blade or a flat inclined curve-type blade of the upper blade body; and wherein the distal end portion of the lower blade body plays a role of a lever to apply a force to the upper and lower inclined curve-type blades for cutting a user's nail.

Advantageous Effects

As described above, according to the inventive method for manufacturing an inclined curve-type blade body of a nail clipper, 3-dimensional inclined curve-type blades which are exactly engaged with each other can be formed on the inclined surfaces of the upper and lower blade bodies facing each other. Moreover, the nail clipper having the inclined curve-type blades which are exactly engaged with each other can be mass produced regardless of a deviation of the grinding depth. In addition, the user can cut his/her nail in a curved shape along its curvature without any damage incurred by the shearing operation during the nail cutting.

BRIEF DESCRIPTION OF THE DRAWINGS

The above and other aspects, features and advantages of the present invention will be more apparent from the following detailed description taken in conjunction with the accompanying drawings, in which:

FIG. 15(*b*) is a front view showing the engaged upper and lower blades from the outside; FIG. 15(*c*) is a plan view; FIG. 15(*d*) is a bottom view; and FIG. 15(*e*) is a view showing the curvature of the upper inclined surface; FIG. 16(*b*) is a front view showing the engaged upper and lower blades from the outside; FIG. 16(*c*) is a plan view; and FIG. 16(*d*) is a bottom view.

BEST MODE

Mode for Invention

Figure 1:
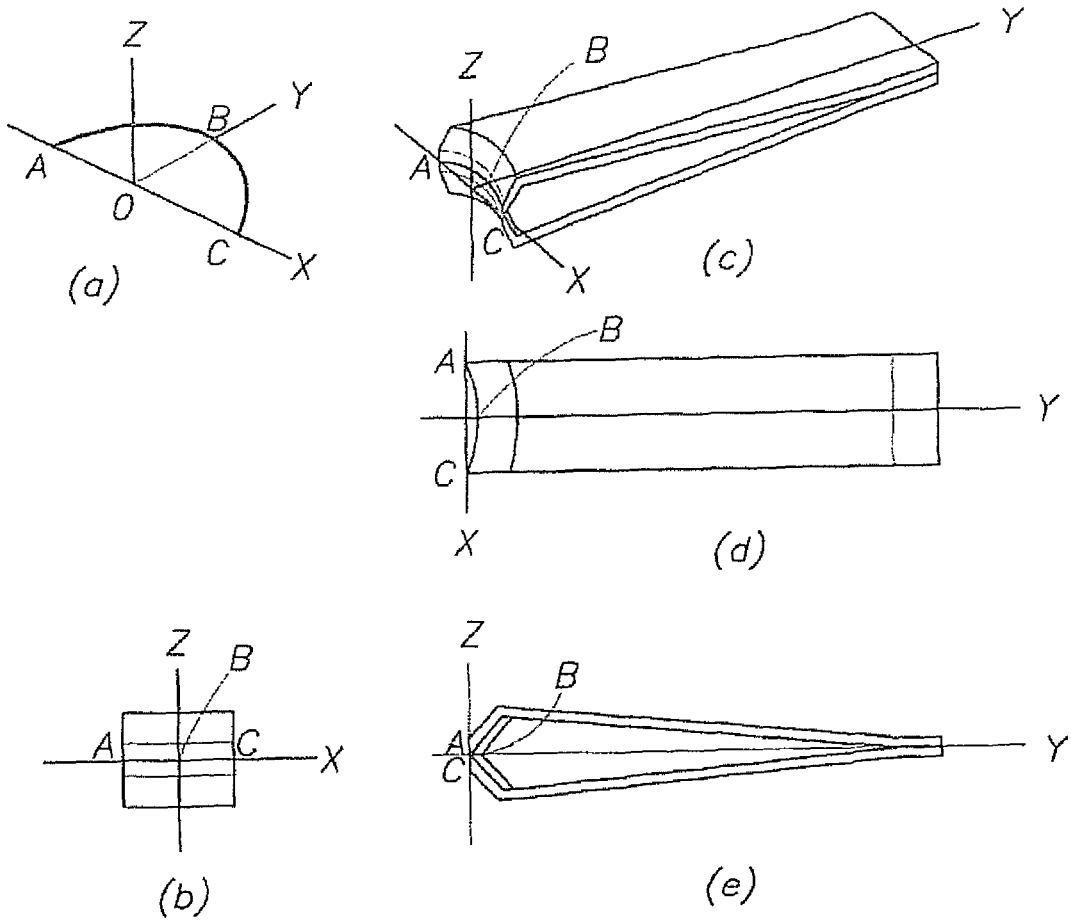
FIG. 1 (Prior Art)
FIG. 1 is a schematic view of a conventional nail clipper, wherein FIG. 1(*a*) shows upper and lower blade bodies in a 3-dimensional space which are engaged with each other with a horizontal curve (A-B-C) in the X-Y plane, FIG. 1(*b*) is a front view of the engaged blades, FIG. 1(*c*) is a perspective view, FIG. 1(*d*) is a plan view, and FIG. 1(*e*) is a side elevational view seen from the right side.
Figure 2:
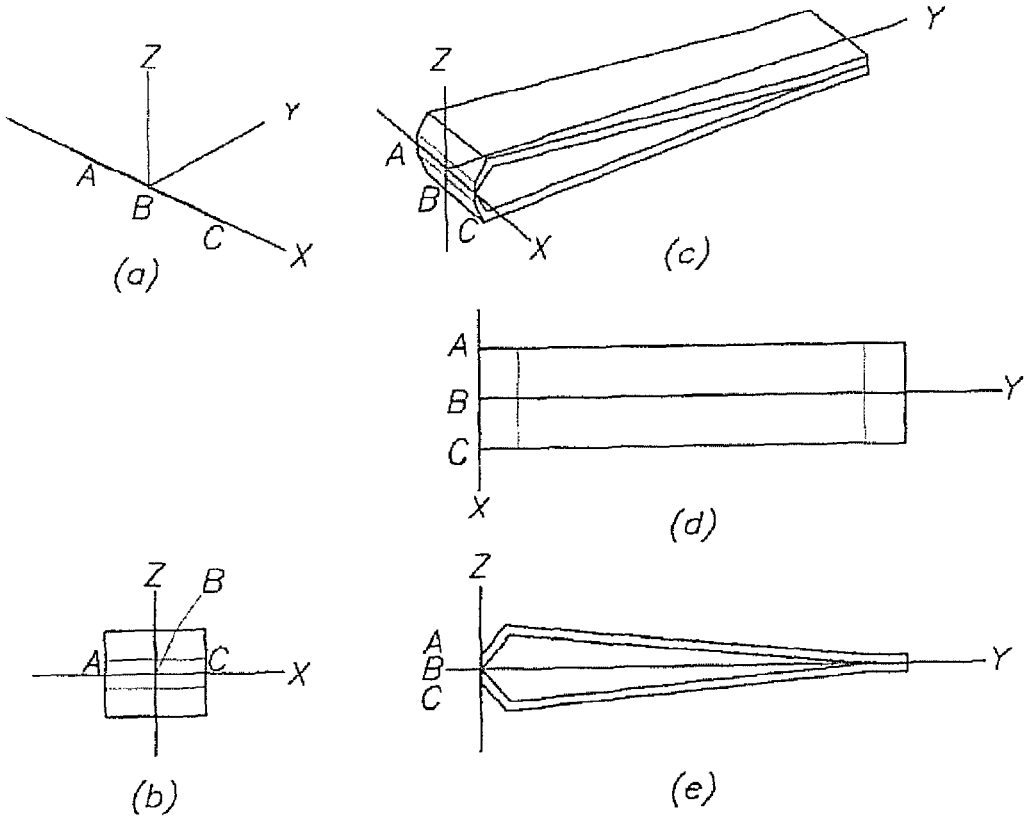
FIG. 2 (Prior Art)
FIG. 2 is a schematic view of a conventional nail clipper, wherein FIG. 2(*a*) shows the upper and lower blade bodies in a 3-dimensional space which are engaged with each other with a straight line (A-B-C) in the X axis, FIG. 2(*b*) is a front view of the engaged blades, FIG. 2(*c*) is a perspective view, FIG. 2(*d*) is a plan view, and FIG. 2(*e*) is a side elevational view seen from the right side.
Figure 3:
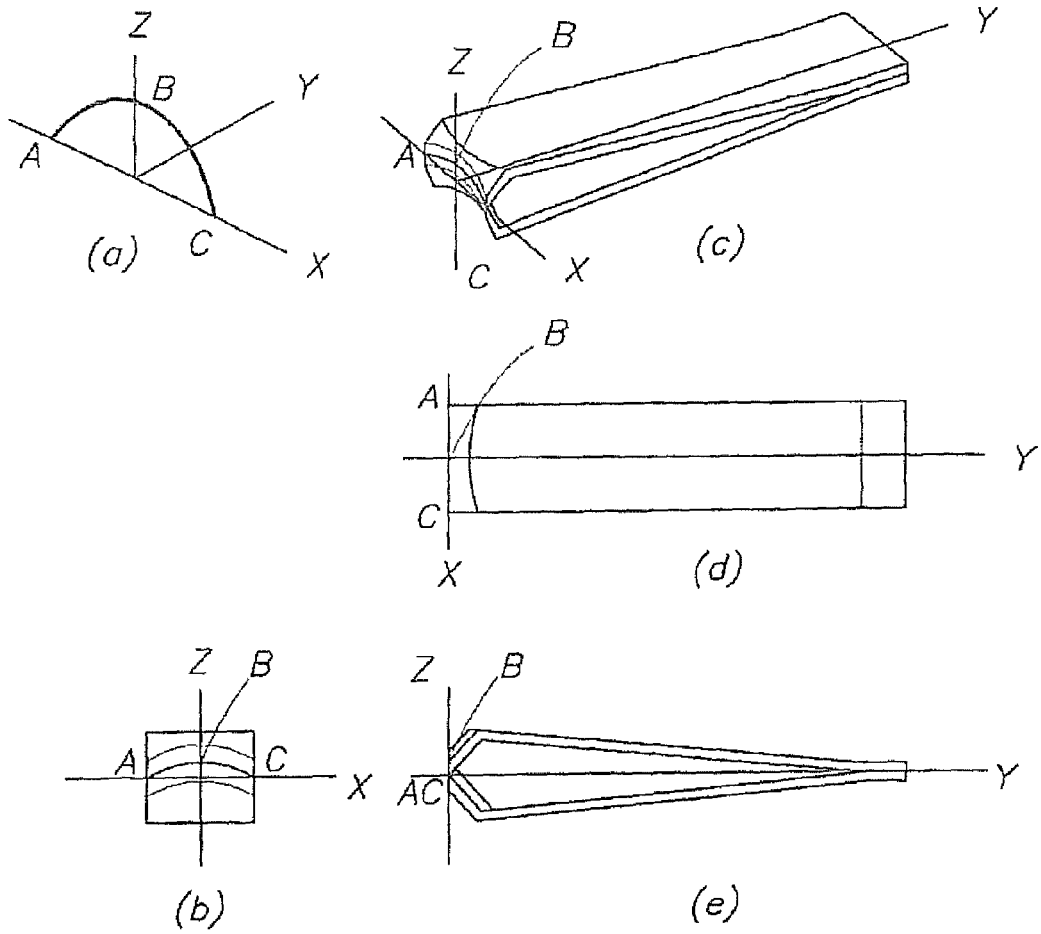
FIG. 3 (Prior Art)
FIG. 3 is a schematic view of a conventional nail clipper, wherein FIG. 3(*a*) shows the upper and lower blade bodies in a 3-dimensional space which are engaged with each other with a vertical curve (A-B-C) in the X-Z plane, FIG. 3(*b*) is a front view of the engaged blades, FIG. 3(*c*) is a perspective view, FIG. 3(*d*) is a plan view, and FIG. 3(*e*) is a side elevational view seen from the right side.

Hereinafter, exemplary embodiments of the present invention will be described with reference to the accompanying drawings. In the following description, the same elements will be designated by the same reference numerals although they are shown in different drawings.

Figure 4:
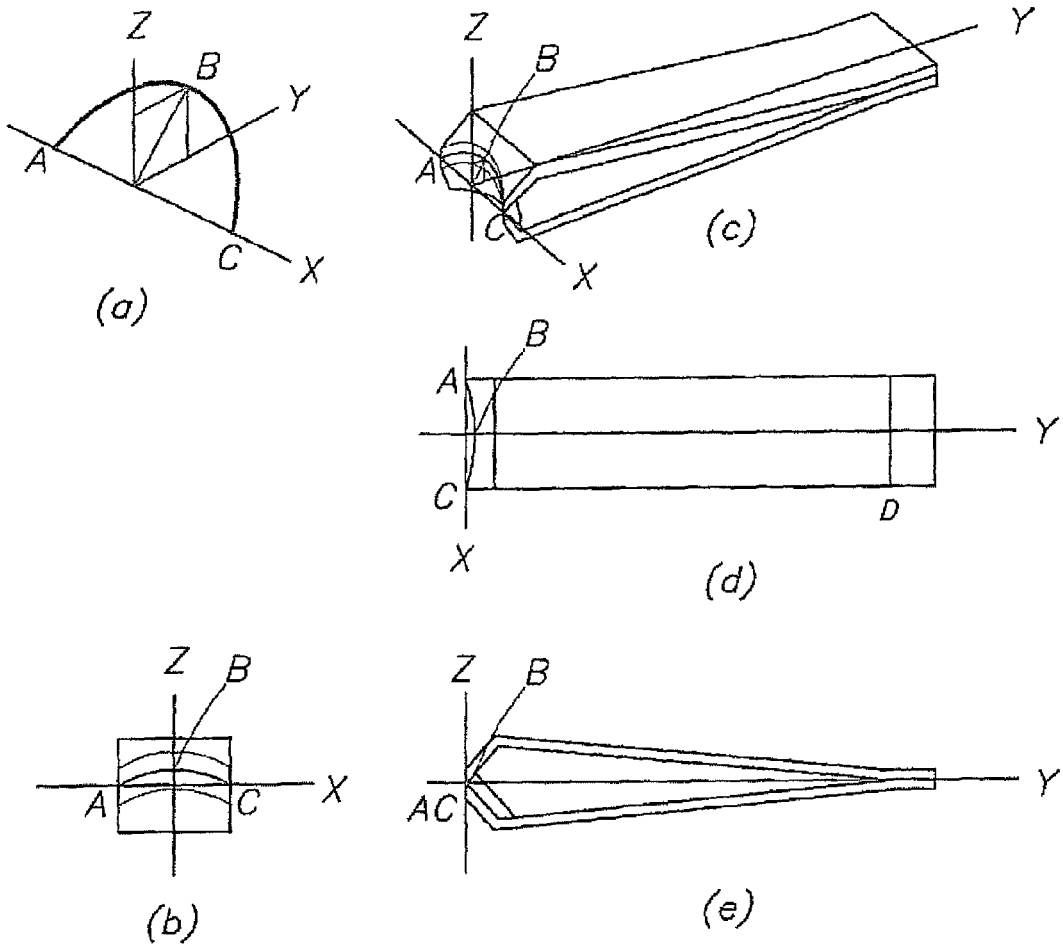
FIG. 4 is a schematic view of an inclined curve-type nail clipper in accordance with the present invention whose upper inclined surface is formed with a flat surface, wherein FIG. 4(*a*) shows the upper and lower blade bodies in a 3-dimensional space which are engaged with each other with an inclined curve (A-B-C) in the X-Y-Z space, FIG. 4(*b*) is a front view of the engaged blades, FIG. 4(*c*) is a perspective view, FIG. 4(*d*) is a plan view, and FIG. 4(*e*) is a side elevational view seen from the right side.

FIG. 4 (*a*) is a schematic view of an inclined curve-type nail clipper in accordance with the present invention showing that the upper and lower blade bodies are engaged with each other with an inclined curve (A-B-C) in a 3-dimensional (X-Y-Z) space, FIG. 4(*b*) is a front view of the engaged blades, FIG. 4(*c*) is a perspective view, FIG. 4(*d*) is a plan view illustrating that the inclined surface of the upper blade is a flat surface, and FIG. 4(*e*) is a side elevational view seen from the right side.

Figure 5:
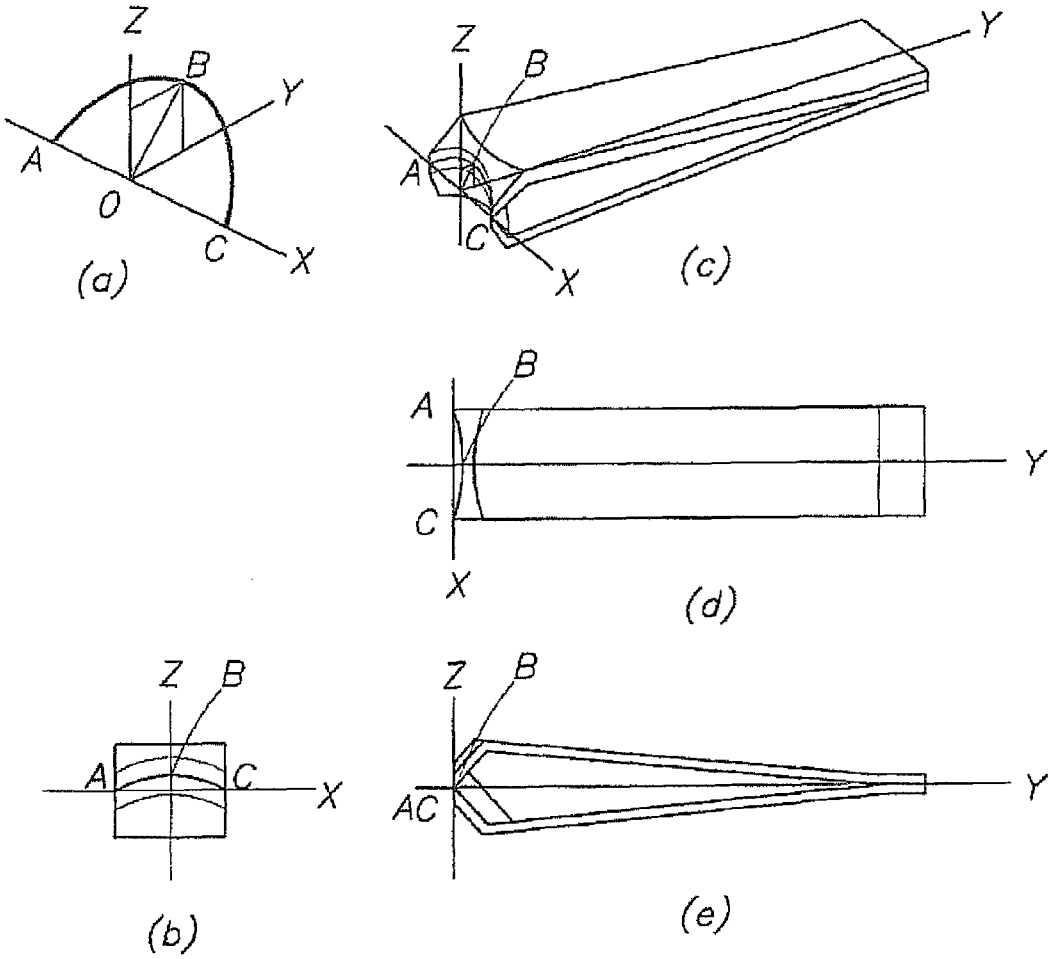
FIG. 5 is a schematic view of an inclined curve-type nail clipper in accordance with the present invention whose upper inclined surface is formed with a curved surface, wherein FIG. 5(*a*) shows the upper and lower blade bodies in a 3-dimensional space which are engaged with each other with an inclined curve (A-B-C) in the X-Y-Z space, FIG. 5(*b*) is a front view of the engaged blades, FIG. 5(*c*) is a perspective view, FIG. 5(*d*) is a plan view, and FIG. 5(*e*) is a side elevational view seen from the right side.

FIG. 5 (*a*) is a schematic view of an inclined curve-type nail clipper in accordance with the present invention showing that the upper and lower blade bodies are engaged with each other with an inclined curve (A-B-C) in a 3-dimensional (X-Y-Z) space, FIG. 5(*b*) is a front view of the engaged blades, FIG. 5(*c*) is a perspective view, FIG. 5(*d*) is a plan view illustrating that the inclined surface of the upper blade is a curved surface, and FIG. 5(*e*) is a side elevational view seen from the right side.

Figure 6:
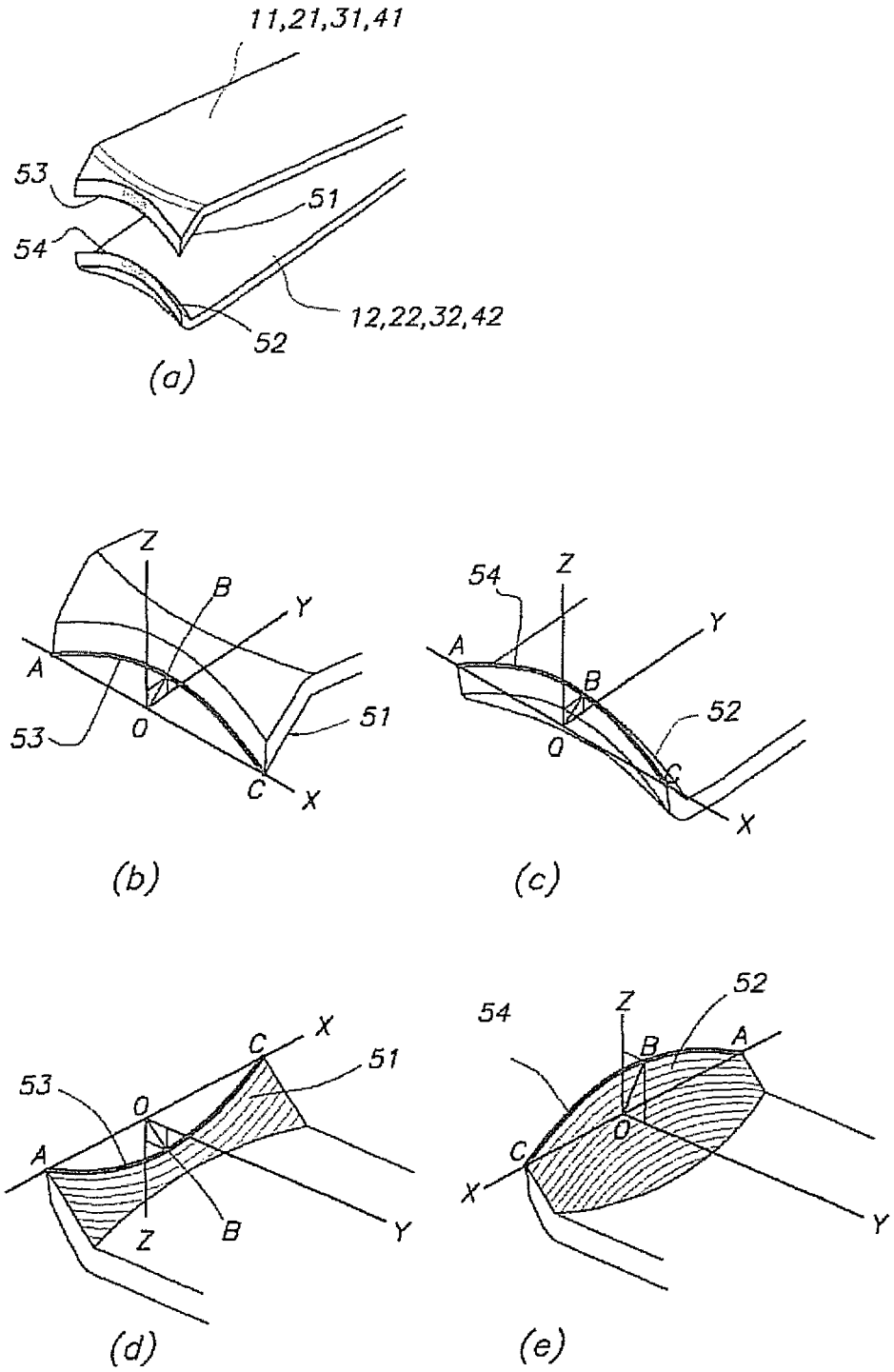
FIG. 6 is a partial perspective view illustrating the detailed construction of the upper and lower inclined curve-type blades in accordance with the present invention, wherein FIG. 6(*a*) shows the upper and lower blades, FIGS. 6(*b*) and 6(*c*) show the inclined curve (A-B-C) is tilted in a Y direction in the X-Y-Z space, FIG. 6(*d*) shows an upper blade formed on the inner side of the upper blade body, and FIG. 6(*e*) shows a lower blade formed on the inner side of the lower blade body.

FIG. 6 illustrates the detailed construction of the upper and lower blade bodies shown in FIG. 5(*a*). FIG. 6(*a*) shows that an upper inclined surface 51 of an upper blade body 11, 21, 31 or 41 is formed with an upper inclined curve-type blade 53 in accordance with the present invention, while a lower inclined surface 52 of a lower blade body 12, 22, 32 or 42 is formed with a lower inclined curve-type blade [53]54 in accordance with the present invention, respectively.

That is, as shown in FIG. 6(*b*), the upper inclined curve-type blade 53 is so constructed to be a 3-dimensional blade that the opposite ends of the blades 54 make contacts at the points A and C in the X axis, respectively, and the central point B of the blade 53 is tilted in the Y axis direction in the X-Y-Z space. Similarly, FIG. 6(*c*) shows that the lower inclined curve-type blade 54 is also a 3-dimensional blade, wherein the opposite ends of the blades 54 make contacts at the points A and C in the X axis, respectively, and the central point B of the blade 53 is tilted in the Y axis direction in the X-Y-Z space.

In other words, FIG. 6(*d*) shows the inside construction of the upper blade body in FIG. 6(*b*) by turning the same upside down, which illustrates the upper inclined curve-type blade 53 consisting of an inclined curve (A-B-C) is formed on the upper inclined surface 51. Likewise, FIG. 6(*e*) shows the inside construction of the lower blade body in FIG. 6(*c*), which illustrates the lower inclined curve-type blade 54 consisting of the inclined curve (A-B-C) is formed on the lower inclined surface 52.

At this point, it can be appreciated that the upper and lower inclined curve-type blades 53 and 54 are, as shown in FIGS. 6(*d*) and 6(*e*), obtained by extending the inclined curve (A-B-C) which is formed in the 3-dimensional X-Y-Z space onto the upper and lower inclined surfaces 51 and 52. The detailed description thereof will be explained hereinbelow with reference to FIGS. 13 to 15.

Figure 7:
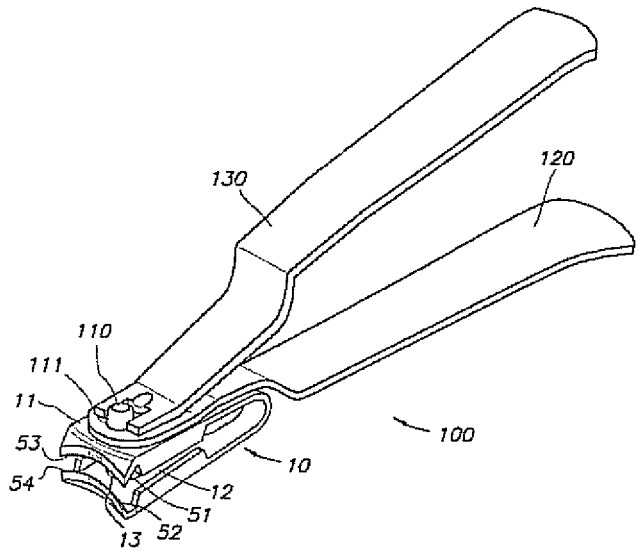
FIG. 7 is a perspective view illustrating the nail clipper having the blade body with the inclined curve-type blade in accordance with a preferred embodiment of the present invention, wherein the blade body is rotatably coupled with a nail clipper body and a lever through a supporting shaft.

FIG. 7 is a perspective view illustrating a nail clipper 100 in accordance with a preferred embodiment of the present invention. The nail clipper 100 includes a nail clipper body 120 formed with a supporting shaft hole 111 at its one end portion. A blade body 10 of the present invention provided with another supporting shaft hole 13, which corresponds to the supporting shaft hole 111 as the above, is freely rotatably coupled under the nail clipper body 120 through a supporting shaft 110. Rotatably coupled at the upper end of the supporting shaft 110 is a lever 130 which applies a downward force necessary for the clipping operation of the nail using a leverage principle through the nail clipper body 120.

At this point, the blade body 10 includes the upper blade body 11 and the lower blade body 12, which are correspondingly formed therewith facing each other. The downward inclined surface 51 is formed at a predetermined angle at the end of the upper blade body 11 (referred to as "upper inclined surface 51" hereinafter). The upper inclined curve-type blade 53 in accordance with the present invention described hereinbelow is provided on the upper inclined surface 51. Meanwhile, the upward inclined surface 52 facing the upper inclined surface 51 is correspondingly formed at the end of the lower blade body 12 (referred to as "lower inclined surface 52" hereinafter). The lower inclined curve-type blade 54 in accordance with the present invention described hereinafter, corresponding to the upper inclined curve-type blade 53, is provided on the lower inclined surface 52.

Figure 11:
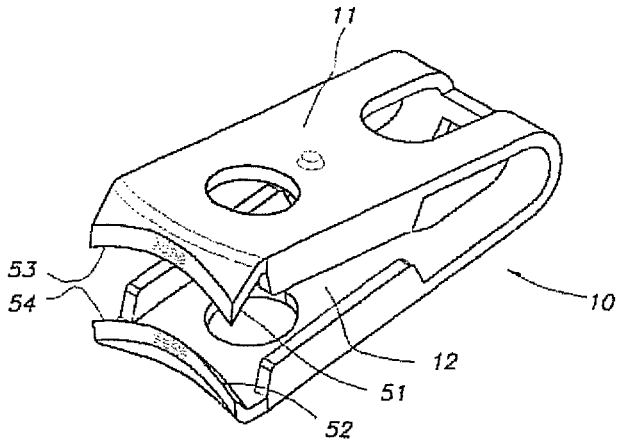
FIG. 11 is a perspective view illustrating the blade body with the inclined curve-type blade in accordance with the present invention, wherein the upper blade body is integrally formed with the lower blade body by a bending work.
Figure 12:
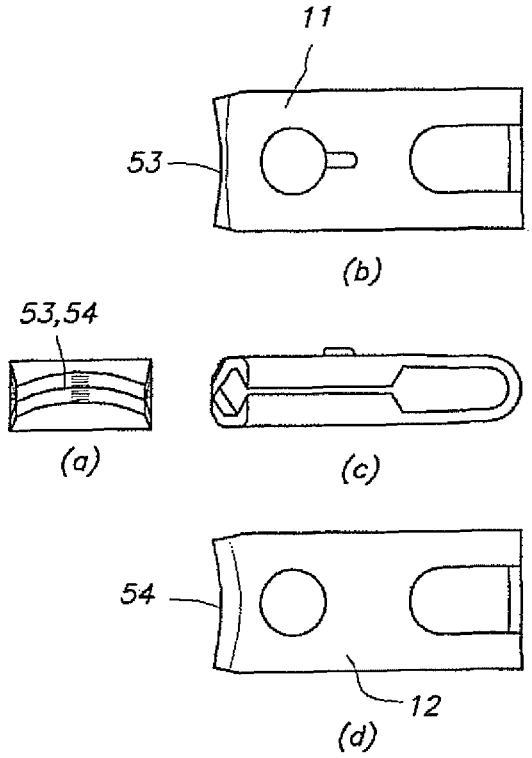
FIG. 12 is a schematic view illustrating an engagement state where the upper and lower blades of the blade body of FIG. 11 are closely engaged with each other, wherein FIG. 12(*a*) is a front view, FIG. 12(*b*) is a plan view, FIG. 12(*c*) is a side elevational view seen from the right side, and FIG. 12(*d*) is a bottom view.

As shown in FIGS. 11 and 12 in detail, the blade body 10 is prepared to be formed with the upper and lower blade bodies 11 and 12 at the opposite ends of a longitudinally extending metal sheet, respectively. The metal sheet is then bent at an imaginary center line in the longitudinal direction thereof so that the upper inclined surface 51 exactly faces the lower inclined surface 52. When the upper and lower blade bodies 11 and 12 are pressed using a lever 130, the upper and lower blade bodies 11 and 12 are engaged with or separated from each other to perform the nail clipping operation with the inclined curve-type blades 53 and 54. At this moment, the blade body 10 is freely rotatable at 360 degrees about the supporting shaft 110 with respect to the nail clipper body 120.

Figure 8:
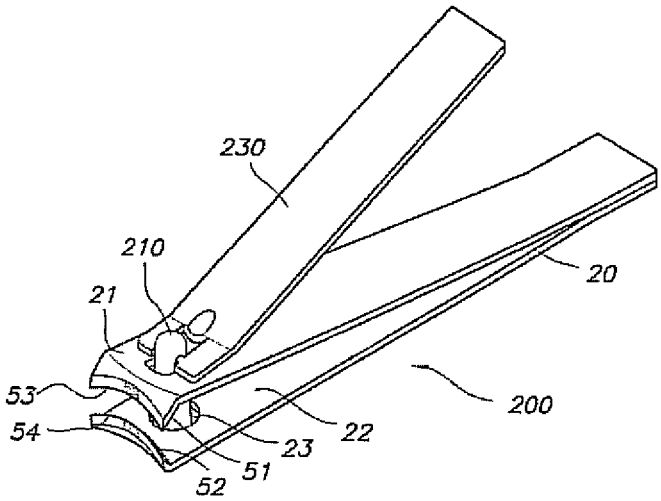
FIG. 8 is a perspective view illustrating the nail clipper having the blade body with the inclined curve-type blade in accordance with another embodiment of the present invention, wherein the blade body is coupled with a lever through a supporting shaft.

FIG. 8 is a perspective view of the nail clipper 200 in accordance with another embodiment of the present invention. The nail clipper 200 is made by applying the inclined curve-type blades 53 and 54 in accordance with the present invention to the conventional nail clipper. In other words, the blade body 20 is composed of the upper blade body 21 and the lower blade body 22. The inclined curve-type blades 53 and 54 in accordance with the present invention are formed on the inclined surfaces 51 and 52 at the end portions of the upper and lower blade bodies 21 and 22, respectively. The rear ends of the upper and lower blade bodies 21 and 22 are secured to each other with a conventional joining means, such as a spot welding, a riveting, a clinching, an eyeleting, a brazing, a dovetailing, a bending work or the like, so the upper and lower blade bodies 21 and 22 are integrally joined with each other. A lever 230 is coupled with the blade body 20 through a supporting shaft 210 which is penetrated into a supporting shaft hole 23, so that the lever 230 presses down the inclined curve-type blades 53 and 54 to cut the user's nail.

Figure 9:
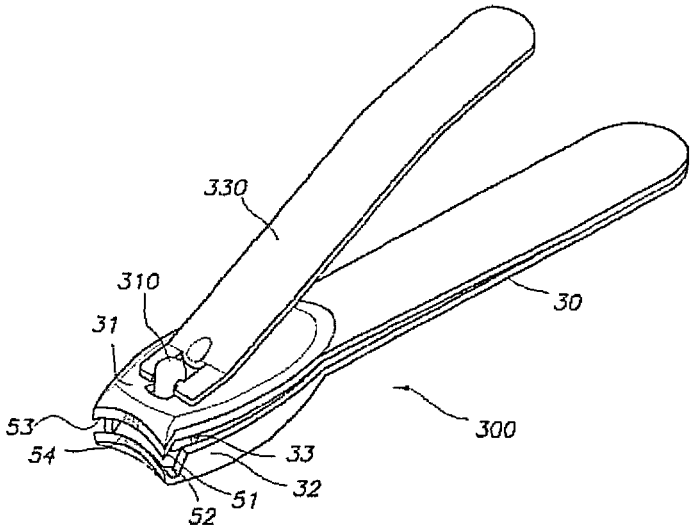
FIG. 9 is a perspective view illustrating the nail clipper having the blade body with the inclined curve-type blade in accordance with still another embodiment of the present invention, wherein the blade body is provided with a spoon-shaped nail collecting part.

FIG. 9 is a perspective view of the nail clipper 300 in accordance with still another embodiment of the present invention, in which favorable modifications are made to the nail clipper shown in FIG. 8. That is, the nail clipper 300 is characterized in that spoon-shaped nail collecting parts are correspondingly provided at the respective end portions of the upper and lower blade bodies 31 and 32 of the blade body 30 having the inclined curve-type blades 53 and 54. Hence, the nail clipper 300 as constructed above is able to effectively prevent the nail being cut from scattering towards the surroundings, thereby providing a hygienic environment. Similar to the nail clipper shown in FIG. 8, a lever 330 is coupled with the blade body 30 through a supporting shaft 310 which is penetrated into a supporting shaft hole 33, which allows the lever 330 to press down the inclined curve-type blades 53 and 54 to cut the user's nail.

Figure 10:
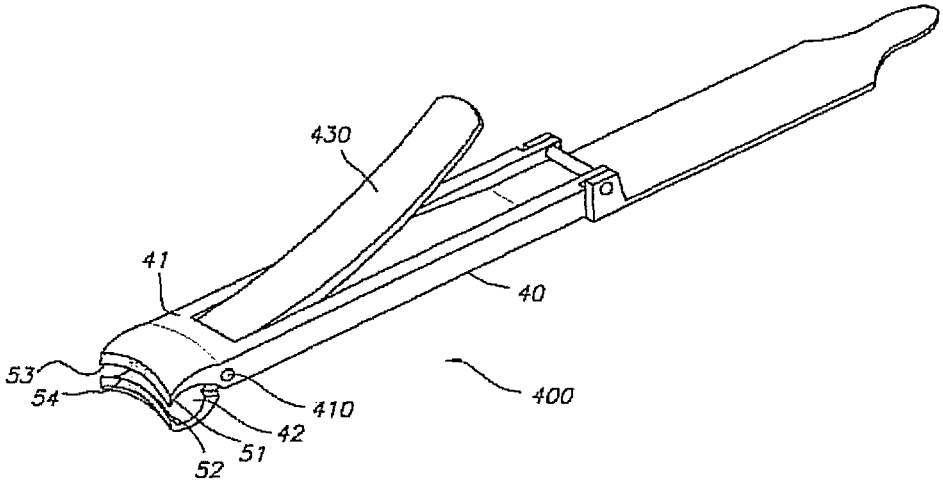
FIG. 10 is a perspective view illustrating a flat-type nail clipper having the inclined curve-type blade at the inclined surfaces of the upper and lower blade bodies in accordance with still another embodiment of the present invention.

FIG. 10 is a perspective view of the nail clipper 400 in accordance with still another embodiment of the present invention, which is a slim-type nail clipper called a flat-type nail clipper. The nail clipper blade body 40 is divided into the upper blade body 41 and the lower blade body 42. The inclined surfaces 51 and 52 of the upper and lower blade bodies 41 and 42 are formed with the inclined curve-type blade 53 and 54 in accordance with the present invention as described above, respectively. The upper and lower blade bodies 41 and 42 are pivotably coupled with each other about a pivot axis, i.e., a pin 410 at a location adjacent to the upper and lower inclined surfaces 51 and 52. Hence, without a separate lever as shown in FIGS. 8 and 9, the distal end of the lower blade body 42 serves as a lever 430 and is pivoted about the pin 410 to press the inclined curve-type blades 53 and 54 for cutting the user's nail.

FIG. 11 is a perspective view of the blade body 10 shown in FIG. 7, which is separated from the main body 120 of the nail clipper 100. FIG. 11 clearly shows the construction of the blade body 10 which is bent at the imaginary center line in its longitudinal direction to form the upper and lower blade bodies 11 and 12, facing each other on the inclined surfaces 51 and 52, having the respective inclined curve-type blades 53 and 54 in accordance with the present invention.

FIG. 12 is a schematic view of the blade body 10 of FIG. 11, wherein FIG. 12(*a*) is a front view, FIG. 12(*b*) is a plan view, FIG. 12(*c*) is a side elevational view seen from the right side, and FIG. 12(*d*) is a bottom view. As shown in FIG. 12, it can be appreciated that the inclined curve-type blades 53 and 54 of the present invention provide a blade engagement in the shape of an upward curve-type as seen from the front view, while the blades are in the form of concave blades as seen from both the plan view and the bottom view.

Meanwhile, the inclined curve-type blades 53 and 54 of the present invention as shown in FIGS. 7 to 12 have been made by the same technical principle. Such a technical principle to form and manufacture the inclined surfaces 51 and 52 as well as the inclined curve-type blades 53 and 54 in the blade body 10, 20, 30 or 40 of the nail clipper will be described in detail with reference to FIGS. 13 to 15 hereinbelow.

Figure 13:
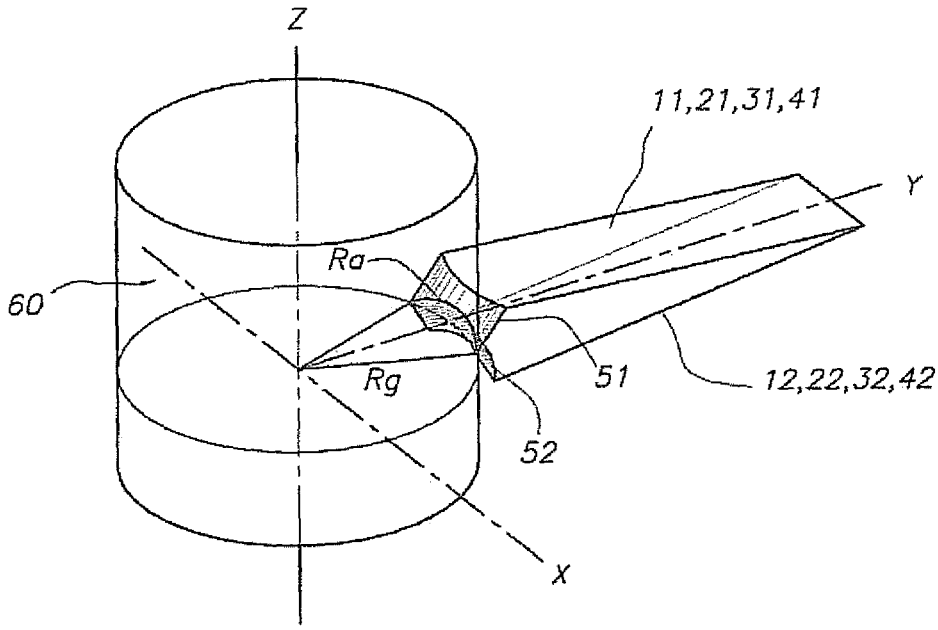
FIG. 13 is a schematic perspective view illustrating the theory of forming the inclined curve-type blade body in accordance with the present invention, wherein the inclined curve is obtained when the inclined surface of the blade body makes contact with grinding media.

FIG. 13 illustrates the positional relationship between the nail clipper blade body and cylindrical grinding media 60 to be used for grinding works. The center of the grinding media 60 is located in the Z axis, and the center line of the upper blade body 11, 21, 31 or 41 and the lower blade body 12, 22, 32 or 42 lower bodies is located in the Y axis to be merged with the Z axis. When the inclined surface 51 of the upper blade body 11, 21, 31 or 41 and the inclined surface 52 of the lower blade body 12, 22, 32 or 42 are merged into the outer periphery of the grinding media 60 with a radius Rg maintaining a perpendicular angle therebetween, it can be noted that an inclined curve with a predetermined curvature Ra is formed at their contacting portions.

Figure 14:
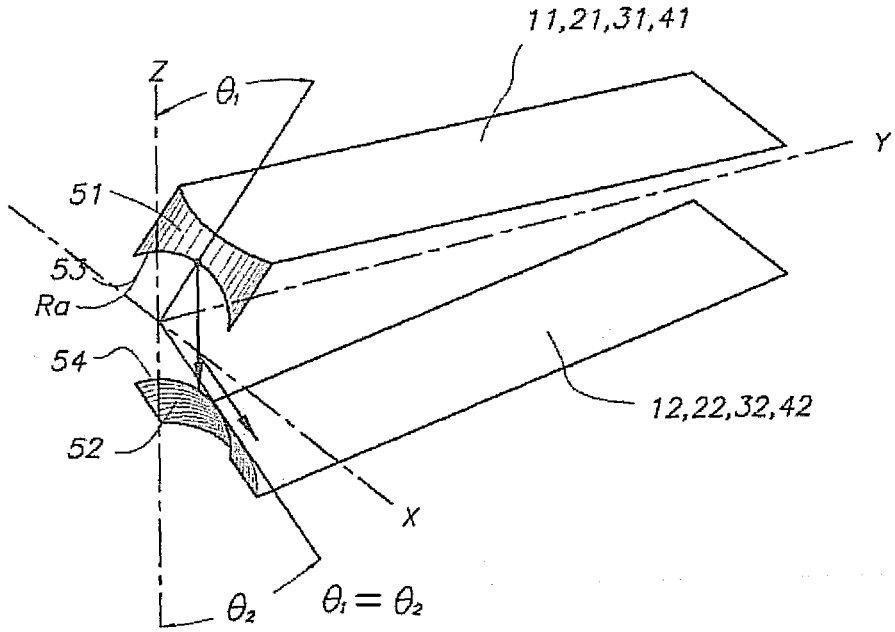
FIG. 14 is a schematic perspective view illustrating the theory of forming the upper and lower inclined curve-type blades of the blade body in accordance with the present invention, wherein the inclined curve formed by bringing the inclined surface of the upper blade body contact with grinding media is extended downward at an inclination angle corresponding to the inclination angle of the upper inclined surface to form a trajectory, and wherein the lower inclined surface is obtained by forming a surface along the trajectory.

Referring to FIG. 14, the upper blade body 11, 21, 31 or 41 and the lower blade body 12, 22, 32 or 42 are shown as separated from each other for simplicity. It can be appreciated that the inclined curve with the curvature Ra, which is formed when the inclined surface 51 of the upper blade body 11, 21, 31 or 41 merges into the grinding media 60, is consecutively extending downward at the same angle corresponding to the inclination angle of the inclined surface 51 to form a trajectory and makes a surface using such a trajectory to finally form the lower inclined surface 52 of the lower blade body 12, 22, 32 or 42.

In other words, as shown in FIG. 14, the inclined surfaces 51 and 52 having the same inclination angles $\theta_1$ and $\theta_2$ with respect to an imaginary vertical line are formed at the end portion of the upper blade body 11, 21, 31 or 41 and the lower blade body 12, 22, 32 or 42 of the nail clipper blade body. Here, the inner side of the upper inclined surface 51 provided at the upper blade body 11, 21, 31 or 41 is a concave curved surface (refer to FIGS. 6(*b*) and (*d*)) having a flat surface or a predetermined curvature Rb (reference numeral 70 in FIG. 15), which is formed along the entire length of the upper inclined surfaces 51. The cylindrical grinding media 60 with the radius Rg is then brought into contact with the inclined surface 51 as such. When the inclined surface 51 is merged with the outer periphery of the grinding media 60, the grinding media 60 and the inclined surface 51 form the inclined curve with a predetermined curvature Ra at the boundary line therebetween. Then, this means that the upper and lower blade bodies are obtained by making the respective inside surfaces form the upper and lower inclined surfaces according to the aforementioned ways. Therefore, when the upper inclined surface 51 is put into the grinding operation using the cylindrical grinding media 60 with the radius Rg, the upper inclined curve-type blade 53 is then formed on the inclined surface 51 accordingly (refer to FIGS. 6(*b*) and (*d*)).

Meanwhile, the upper inclined curve-type blade 53 formed at the upper blade body 11, 21, 31 or 41 is itself consecutively extending downward at the angle $\theta_2$ corresponding to the angle $\theta_1$ of the upper inclined surface 51 to form a trajectory and makes a closed curved surface using such trajectory on the lower inclined surface 52. Then, the closed curved surface will become the inclined curve-type blade 54 of the lower blade body 12, 22, 32 or 42, corresponding to the upper inclined curve-type blade 53 and also being exactly engaged therewith. In other words, the cylindrical grinding media 60 with the radius Rg is placed in the upright position, and then the lower inclined surface 52 is brought into contact with the outer periphery of the grinding media 60. Then, the lower inclined surface 52 makes contact with the grinding media 60, while forming an inclined curve with the predetermined curvature Ra therebetween. Accordingly, with the geometrical relationship as the above, when the end portion of the lower inclined surface 52 is ground using the cylindrical grinding media 60 with the radius Rg, the lower inclined curve-type blade 54 is finally formed on the lower inclined surface 52, corresponding to the inclined curve having the curvature Ra.

Hence, when the end portions of the upper blade body 11, 21, 31 or 41 and the lower blade body 12, 22, 32 or 42 are simultaneously ground using the cylindrical grinding media 60 with the radius Rg, a rearward inclined concave curve-type blade 53 (refer to FIGS. 6(*b*) and (*d*)) is formed on the inside of the upper blade body 11, 21, 31 or 41 along its longitudinal direction. Similarly, a rearward inclined convex curve-type blade 54 (refer to FIGS. 6(*c*) and (*e*)) is formed on the inside of the lower blade body 12, 22, 32 or 42 along its longitudinal direction. That is, the inclined curve-type blades 53 and 54 which are completely corresponding to each other in their geometric conformities can be simultaneously manufactured by the grinding work as the above.

At this point, it should be noted that even though there is a deviation in the relative position of the end portions of the upper blade body 11, 21, 31 or 41 and the lower blade body 12, 22, 32 or 42 with respect to the grinding media 60, i.e., a deviation in the penetrating depth into the latter in the grinding work, the inclined curve-type blades 53 and 54 having the same shapes are obtained by the grinding work. This is the unique feature of the present invention to provide the upper and lower blades having 3-dimensional structures, wherein the inclined curve-type blades 53 or 54 with the same curvature Ra and without any changes in their geometries can be formed on the respective inclined surfaces 51 and 52. It can be appreciated that such a feature has been the technical basis for mass-producing the nail clipper having the inventive upper and lower blade bodies because the inclined curve-type blades 53 or 54 having the same geometric constructions can be manufactured regardless of the deviation in the grinding depth due to skillfulness of the worker, jigs used in the grinding work or the like.

Figure 15:
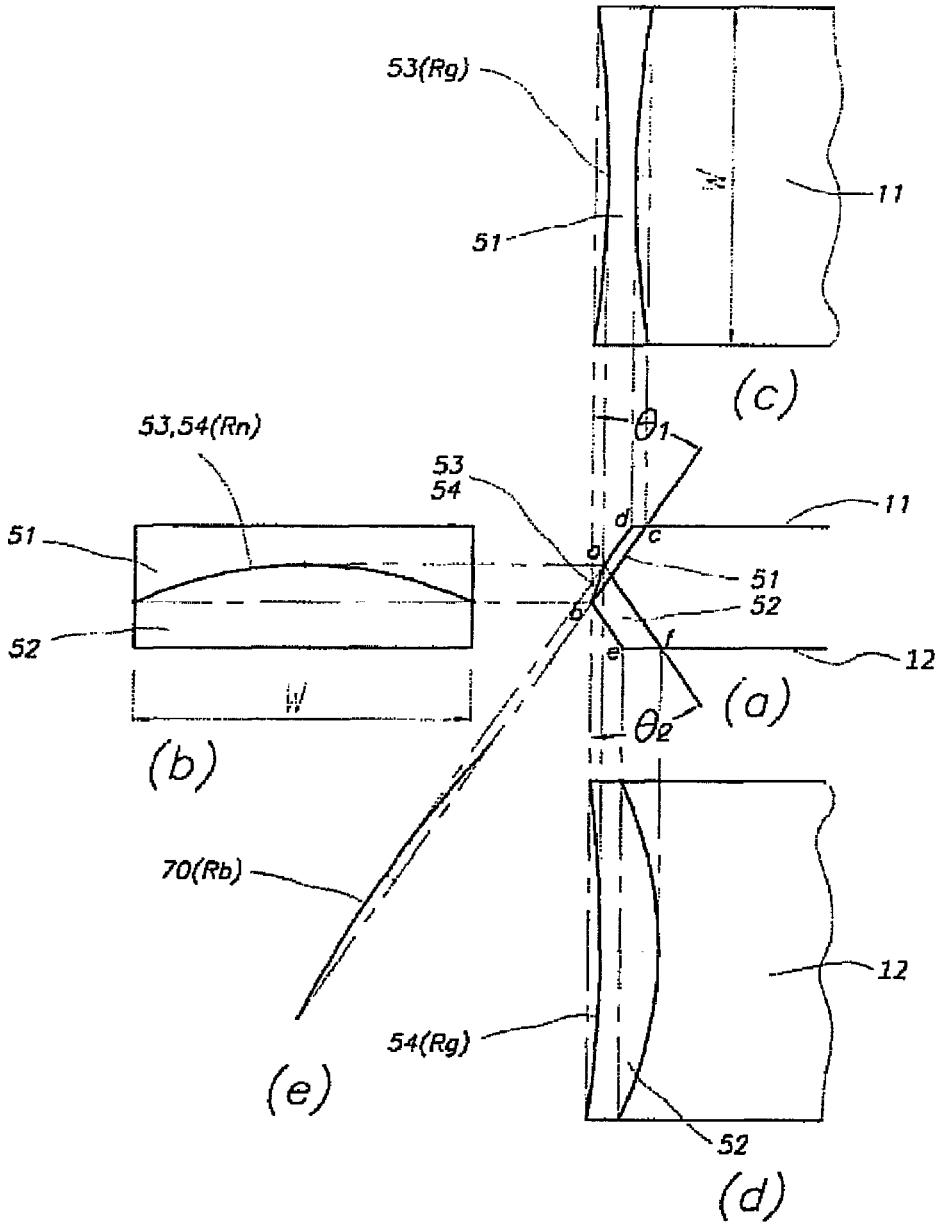
FIG. 15 is a schematic view for analyzing the geometric construction of the inclined curve-type blades in accordance with the present invention, wherein FIG. 15(*a*) is a side elevational view showing the end portions of the upper and lower blade bodies.

FIG. 15 is a schematic view for analyzing the geometric construction of the inclined curve-type blade body in accordance with the present invention. FIG. 15(*a*) is a side elevational view showing the end portions of the upper and lower blade bodies, FIG. 15(*b*) is a front view from the outside showing the engaged upper and lower blades 53 and 54 having the curvature Rn, FIG. 15(*c*) is a plan view, FIG. 15(*d*) is a bottom view, and FIG. 15(*e*) is a view showing the curvature Rb of the upper inclined surface 51.

Referring to FIG. 15(*c*), the curvature Rb of the upper inclined curve-type blade 53 in the plan view is obtained in response to the radius Rg of the grinding media 60 to be used in the grinding work. The inclination angles $\theta_1$ and $\theta_2$ ($\theta_1=\theta_2$) are determined depending upon the sharpness degree of the upper and lower blade bodies, conditions of the manufacturing process or the like, as shown in FIG. 15(*a*). Next, as shown in FIG. 15(*b*), the curvature Rn of the upper and lower inclined curve-type blades 53 and 54 being engaged with each other in the front view is correspondingly determined in response to the curvature of the user's nail to be cut. With the curvature Rn and the radius Rg a closed curve indicated by a-b-c-d is obtained as shown in FIG. 15(*a*). Therefore, as shown in FIG. 15(*e*), a curved surface 70 with the curvature Rb corresponding to the closed curve is formed and used to constitute the upper inclined surface 51 of the upper blade body. In other words, an upper inclined curve indicated by a-b is obtained as shown in FIG. 15 (*a*). Accordingly, when the upper inclined curve is consecutively extended downward at the angle $\theta_2$ corresponding to the angle $\theta_1$ of the upper inclined surface 51 to form a trajectory, a closed curved surface conforming such trajectory constitutes the lower inclined surface 52.

The descriptions as the above may be further explained by using geometry to determine the inclined curve as follows. First, referring to FIG. 15(*b*), the inclined curve can be obtained from the curvature Rn seen from the front view of the nail clipper. That is, in FIG. 15(*a*), the inclination angle $\theta_1$ in the upper blade body is determined. When the width W of the blade and the radius Rg of the grinding media 60 are given, the curvature Rb of the closed curve indicated by a-b-c-d in FIG. 15 (*a*) constituting the upper inclined surface 51, i.e., the upper inclined curved surface 70 in FIG. 15(*e*) is obtained. Hence, the upper inclined curve indicated by a-b is formed as shown in FIG. 15 (*a*). Thereafter, when the upper inclined curve a-b is consecutively extended downward at the angle $\theta_2$ corresponding to the angle $\theta_1$ of the upper inclined surface 51 to form a trajectory, a closed curved surface indicated by a-b-c-d conforming such trajectory may constitute the lower inclined surface 52. That is, the closed curved surface indicated by a-b-c-d constitutes the inclined surface 52 and the inclined curve-type blade 54 of the lower blade body 12.

In contrast, as another embodiment of the present invention, the inclined curve can be obtained after the curvature Rb of the upper inclined surface 51 is determined. That is, when the inclination angle $\theta_1$ of the upper inclined surface 51, the width W of the blade and the radius Rg of the grinding media 60 are given, the upper inclined curve indicated by a-b and its curvature Rn seen from the front view is obtained. Next, when the upper inclined curve a-b is consecutively extended downward at the angle $\theta_2$ corresponding to the angle $\theta_1$ of the upper inclined surface 51 to form a trajectory, a closed curved surface indicated by a-b-e-f conforming such trajectory may constitute the lower inclined surface 52. That is, the closed curved surface indicated by a-b-c-d constitutes the lower inclined surface 52 to form the inclined curve-type blade 54 of the lower blade body 12.

At this point, the inclined curve indicated by a-b has to be regarded as a unitary element, and its length, height, curvature, angle or the like should not be changed or modified. In other words, it is the core technology of the present invention that the inclined curve a-b of the upper blade body 11 is consecutively extended downward at the angle $\theta_2$ corresponding to the angle $\theta_1$ (here, $\theta_1=\theta_2$) to form a trajectory onto the lower blade body 12, thereby constituting the inclined curved surface indicated by a-b-e-f on the lower blade body 12 by using the trajectory as the above. Consequently, this can be interpreted as that even if the upper and lower inclined surfaces 51 and 52 are slightly displaced in a horizontal direction and ground by the grinding media 60 which is rotating in the upright position, the upper and lower inclined curve-type blades 53 and 54 having the same shapes and curvatures can be obtained through the grinding work.

Figure 16:
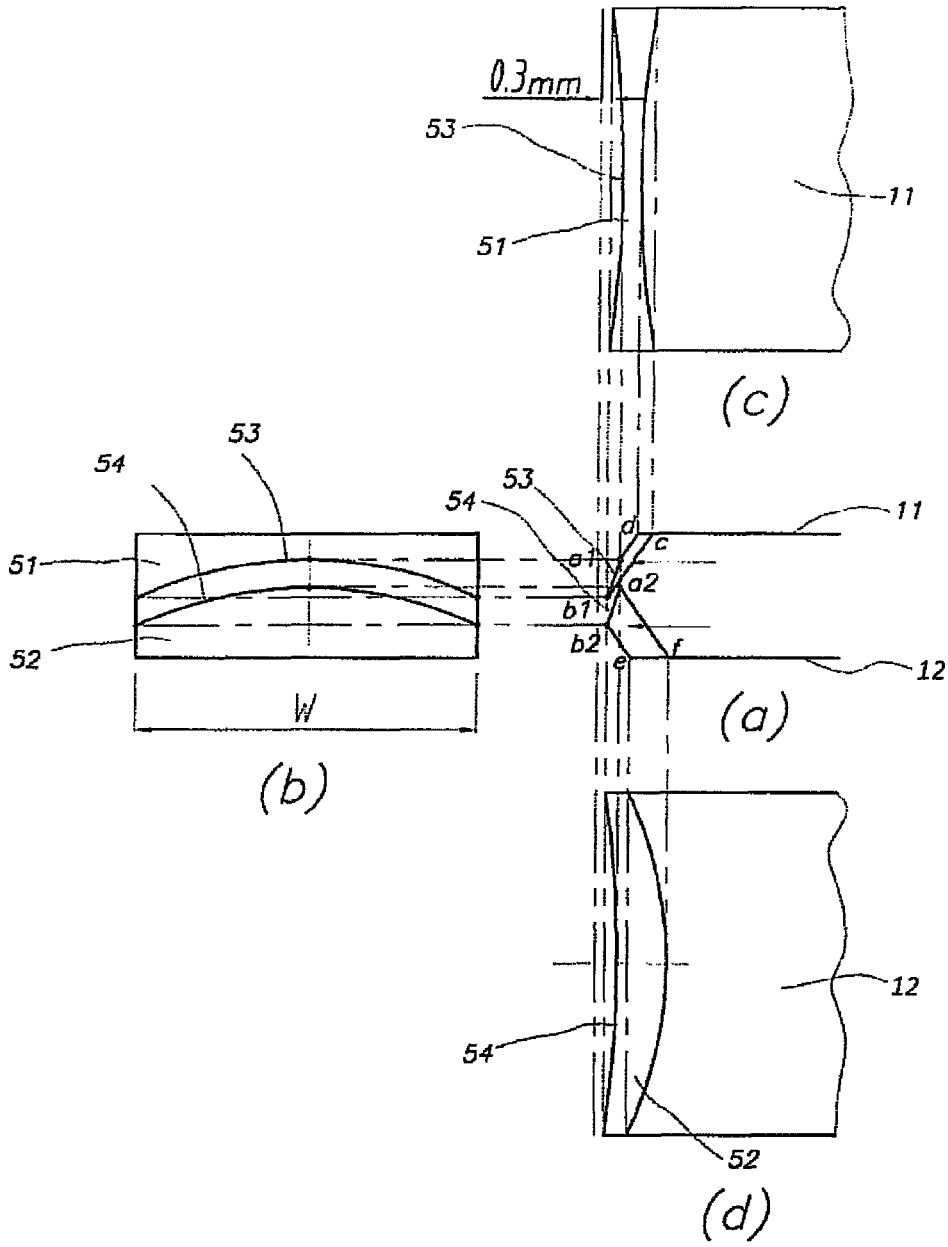
FIG. 16 is a schematic view illustrating a state where the upper and lower blade bodies of the FIG. 15 are supposed to be ground 0.3 mm deeper than those of FIG. 15, wherein FIG. 16(*a*) is a side elevational view showing the end portions of the upper and lower blade bodies.

FIG. 16 is a schematic view illustrating the difference from FIG. 15, supposing that the blade body of the FIG. 15 has been penetrated into and ground by 0.3 mm deeper than that of FIG. 15. FIG. 16(*a*) is a side elevational view showing the end portions of the upper and lower blade bodies, FIG. 16(*b*) is a front view showing the inclined upper and lower blades engaged therewith from the outside, FIG. 16(*c*) is a plan view, and FIG. 16(*d*) is a bottom view.

Referring to FIG. 16(*c*), when the blade body of the FIG. 15 has been penetrated towards the grinding media 60 and ground by 0.3 mm deeper than the reference value of FIG. 15, the two closed curves constituting the upper and lower inclined surfaces 51 and 52 are separated from each other as shown in FIG. 16(*a*), leaving the closed curves indicated by a 1-b1-c-d and a2-b2-e-f, respectively. In other words, it can be noted that the upper curve-type blade 53 indicated by a1-b1 appears to be separated from the lower curve-type blade 54 indicated by a2-b2.

Detailed descriptions thereof will be explained hereinbelow. As shown in the front view of FIG. 16(*b*), the upper and lower inclined surfaces 51 and 52 having the same geometric constructions are horizontally moved by 0.3 mm towards the cylindrical grinding media 60 having the same radius Rg. Then, the upper and lower curve-type blades 53 and 54, which are composed of the same curved surfaces as the inclined curved surface indicated by a-b in FIG. 16(*a*), are slightly shifted upward to be ground accordingly. Despite such a shift, the geometric constructions of the upper and lower curve-type blades 53 and 54 obtained by the grinding work are totally corresponding to each other, which makes it possible to be exactly engaged with each other. This geometric analysis as the above has been proved to lead the same conclusion by a simulation work using 3-dimensional modeling method.

Consequently, it can be appreciated that even though there is a deviation in the grinding depth of the upper and lower blade bodies with respect to the grinding media, the upper and lower inclined curve-type blades which are exactly corresponding to be engaged with each other can be obtained by the grinding work regardless of such a deviation. It should be appreciated that this means that the nail clipper having the inventive upper and lower inclined curve-type blades can be manufactured on commercial basis regardless of the deviation in the grinding depth due to skillfulness of the worker, jigs used in the grinding work or the like.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method for manufacturing a blade body of a nail clipper wherein a 3-dimensional inclined curve-type blade is formed on respective inclined surfaces of upper and lower blade bodies facing each other, comprising steps of:

forming an inclined curve with a curvature Ra using a boundary line which is formed when the periphery of grinding media with a radius Rg located in an upright position is merged with an upper inclined surface having a predetermined angle θ1 with respect to a vertical line;

forming a shape of a lower inclined surface by consecutively extending the inclined curve downward at an angle θ2 corresponding to the predetermined inclination angle θ1 of the upper inclined surface to make a trajectory for forming a surface which constitutes the lower inclined surface;

forming blade bodies by constructing the shape of the upper and lower inclined surfaces obtained in the steps above to be inclined surfaces inside the upper and lower blade bodies of the nail clipper; and grinding the ends of the upper and lower inclined surfaces simultaneously by the grinding media with the radius Rg while maintaining the axis of the grinding media perpendicular to the axis of the upper and lower blade bodies, whereby forming upper and lower inclined curve-type blades having the inclined curve with the curvature Ra, respectively.

2. The method as recited in claim 1, wherein the forming step of the inclined curve with the curvature Ra includes determining the curvature Rn of the upper and lower blade bodies seen from the front view of the nail clipper in response to the curvature of a nail, determining the curvature Rb of the upper inclined surface on the basis of the conditions on the inclination angle θ1, the width W of the blade and the radius Rg of the grinding media to make the shape of the upper inclined surface, and forming the inclined curve with the curvature Ra along the upper inclined surface.

3. The method as recited in claim 1, wherein the forming step of the inclined curve with the curvature Ra includes determining the curvature Rb of the upper inclined surface to make the shape of the upper inclined surface, and forming the inclined curve with the curvature Ra on the basis of the conditions on the inclination angle θ1, the width W of the blade and the radius Rg of the grinding media.

4. The method as recited in claim 1, wherein the upper and lower blade bodies are integrally formed with each other at the opposite ends of a metal sheet, and the metal sheet is bent at an imaginary center line in its longitudinal direction while the upper and lower inclined curve-type blades facing each other.

5. The method as recited in claim 1, wherein the other end portions of the upper and lower blade bodies are secured to each other using a joining means, wherein the joining means is one selected from the group of a spot welding, a riveting, a clinching, an eyeleting, a brazing, a dovetailing, or a bending work.

6. An inclined curve-type blade body of a nail clipper, comprising:

an upper blade body formed with a downward inclined surface at one end; and a lower blade body formed with an upward inclined surface corresponding to the inclined surface of the upper blade body at one end for cutting a user's nail in cooperation with the upper blade body;

wherein the upper and lower blade bodies are provided with upper and lower inclined curve-type blades which are respectively manufactured from a method defined in any one of claims 1 to 5.

7. A nail clipper, comprising:

an upper blade body formed with a downward inclined surface at one end;

a lower blade body formed with an upward inclined surface corresponding to the inclined surface of the upper blade body at one end for cutting a user's nail in cooperation with the upper blade body; and a lever for applying a force to the upper and lower blade bodies to cut the user's nail;

wherein the upper and lower blade bodies are provided with upper and lower inclined curve-type blades which are respectively manufactured from a method defined in any one of claims 1 to 5.

8. The nail clipper as recited in claim 7, wherein the upper and lower blade bodies are provided with a nail collecting part at its respective end portions for preventing the nail being cut from scattering towards the surroundings.

9. The nail clipper as recited in claim 7, wherein the upper and lower blade bodies are provided with supporting shaft holes, respectively, and wherein a main body for applying a force to the upper blade body is coupled between the upper blade body and the lever through a supporting shaft inserted in the supporting shaft holes.

* * * * *